US006592289B1

(12) United States Patent
Weander

(10) Patent No.: US 6,592,289 B1
(45) Date of Patent: Jul. 15, 2003

(54) TECHNIQUE FOR CONTRACTION JOINTS IN CONCRETE PAVEMENT

(76) Inventor: Leonard A. Weander, 1010 Colony La., Lincoln, NE (US) 68505-2112

( * ) Notice: Subject to any disclaimer, the term of this patent is extended or adjusted under 35 U.S.C. 154(b) by 0 days.

(21) Appl. No.: 09/651,549

(22) Filed: Aug. 29, 2000

(51) Int. Cl.[7] ..... E01C 11/02

(52) U.S. Cl. ..... 404/74; 404/47; 404/87; 299/39.3; 125/13.03

(58) Field of Search ..... 404/47, 74, 87; 299/36.1, 39.3, 39.1, 75; 30/371; 125/13.01, 13.03, 14; 451/344, 350, 352, 353

(56) References Cited

U.S. PATENT DOCUMENTS 1,536,178 A * 5/1925 Hackett ..... 299/39.3
3,321,250 A * 5/1967 Truelock ..... 299/39.3
4,181,449 A * 1/1980 Lenker ..... 404/87

FOREIGN PATENT DOCUMENTS

DE 3200862 * 7/1983 ..... 404/87
FR 823205 * 6/1937 ..... 125/14

* cited by examiner

*Primary Examiner*—Heather Shackelford
*Assistant Examiner*—Sunil Singh
(74) *Attorney, Agent, or Firm*—Vincent L. Carney

(57) ABSTRACT

To make a concrete roadway; a continuous section of concrete is poured and cut at an angle of between 5 degrees and 45 degrees downwardly in the direction of traffic flow, to form an angled cut with an overlying surface that can be pressed downwardly by a vehicle to reduce movement of the concrete with respect to the sections on either side of a joint in the pavement. With this cut, vehicles will press a top layer downwardly against a bottom layer. A rotary saw blade mounted at an angle to the roadway is used to cut the concrete.

7 Claims, 10 Drawing Sheets

TECHNIQUE FOR CONTRACTION JOINTS IN CONCRETE PAVEMENT

BACKGROUND OF THE INVENTION

This invention relates to techniques for making joints in concrete pavement.

It is known to pour continuous long strips of pavement and then later to cut joints in the continuous pavement. This process is efficient in highway construction because it is efficient to pour the concrete in continuous strips but joints are needed in the long strips of concrete pavement for temperature related expansion or contraction, weight distribution onto the ground and the like. To cut the pavement, heavy vehicles including saws move across the pavement spaced at periodic intervals along the pavement. The saws are mounted to the underside of the heavy vehicles transverse to the direction of motion of the vehicles and make straight cuts partway through the pavement or in some occasions all the way through. When the cuts are made partway from the top surface toward the bottom surface through the concrete pavement, the pavement cracks from the end of the cut downwardly to its bottom surface.

It is also known to mix within the concrete along with the cement substitute filler materials. These filler materials are frequently waste materials that find disposal within the concrete such as, fly ash or calcine clay. Some of these substitute materials reduce the expansion and contraction of the concrete. Without these particles, the concrete will expand during aging and exert sufficient force against the surfaces at the cut portion to prevent the concrete from moving upwardly and downwardly as traffic passes over them. When some filler materials such as fly ash or calcine clay are mixed in with the concrete, the expansion during aging is reduced and movement at the joints continues.

In the prior art, to prevent excessive displacement and cracking due to the movement of the concrete at the joints, steel load transfer bars are used to hold the joint together at those points. This arrangement has the disadvantage of being expensive and increasing the cost of laying roadways.

SUMMARY OF THE INVENTION

Accordingly, it is an object of the invention to provide a novel technique for applying concrete pavement.

It is a further object of the invention to provide a novel technique for making joints in concrete pavement.

It is a still further object of the invention to provide a novel technique for making joints cut at an angle to the vertical so as to transfer pressure between concrete slabs on opposite sides of the joints in concrete roadways.

It is a still further object of the invention to provide novel equipment for making joints in concrete roadways that are at an angle to the vertical.

It is a still further object of the invention to provide a technique for reducing the cost of laying concrete pavement.

It is a still further object of the invention to provide a technique for reducing the cost of laying concrete pavement by eliminating the need for steel rods to transfer pressure.

In accordance with the above and further objects of the invention, concrete pavement is poured in a continuous strip. After the concrete has hardened, it is cut at a substantially constant angle of between 5 and 45 degrees from the vertical in a plane transverse to the longitudinal axis of the highway or other strip, which plane forms the angle between 5 and 45 degrees with the vertical. The cut is made from the surface of the pavement downwardly at the angle diverging from the vertical plane it intersects at the surface of the pavement of between 5 and 45 degrees (between 85 and 45 degrees from the horizontal surface of the pavement) and in the same general direction as the movement of traffic. With this arrangement, when traffic moves over the joint, the front wheels of the vehicles move from a first slab of concrete onto the top portion of a second slab of concrete at the surface cut and proceeds over the second slab as the cut gets deeper. Experience has shown that the first slab tends to move upwardly and this causes pressure at the joint from the first slab against the second slab at the angled cut. The second slab moves downwardly and this also presses the second concrete slab against the first slab at the cut joint to hold the surfaces compactly together. The pressure at the angle of the joint causes a wedging action and the slabs are forced to move laterally when pressed at the angled joint, thus maintaining contact between adjacent slabs. The cuts may extend at an angle either from the surface of the concrete all the way to the bottom of the concrete or may be cut only partway down such as a third of the way down or more and the remainder of the concrete simply cracks itself.

In addition to being cut at an angle with respect to the horizontal plane the concrete may be cut at an angle in a horizontal plane with the angle being with respect to a vertical plane taken across the length of the highway and the joint extending at the angle from one side of the highway to the other so that the wheels engage the concrete one wheel at a time as it moves forward. This has been done in the prior art. While the cut is preferably made at a constant angle of between 5 and 45 degrees from the vertical starting at the surface of the pavement and diverging downwardly, the angle can be changed as the cut gets deeper and larger angles can be used as long, as the principle of having the first and second slabs press against each other is maintained. Similarly, the cut may be in the direction against the flow of traffic although this is not preferred and can cause some movement of the slabs with respect to each other before the front wheels of the vehicles leave the first slab and press the second slab against the first slab. In the alternative, cuts may be made in opposite directions on alternate joints for convenience since this permits a continuous cut across the roadway without turning the saw around.

The cuts may be made using conventional sawing equipment available on the market or specially adapted adjustable equipment. In the conventional equipment, vehicles containing the saws that are vertically mounted, may be moved upwardly on to a ramp and fixed in place. When the front wheels are on a ramp and the back wheels against the roadway, the normally vertical saw blade will actually be at an angle to the surface of the concrete. It may then be rotated and moved downwardly as customarily done but will cut the concrete at an angle rather than in a substantially straight vertical plane. On the other hand, special equipment adjusted to change the angle of the blade may be used so as to not require the use of ramps.

As can be understood from the above description, the technique and equipment of this invention has the advantage of reducing the cost of making joints in a roadway and provide for joints that do not require steel rods and yet in a superior manner, reduce the amount of cracking and wear at the joints.

BRIEF DESCRIPTION OF THE DRAWINGS

The above noted and other features of the invention will be better understood from the following detailed description when considered in connection with the accompanying drawings, in which.

DETAILED DESCRIPTION

Figure 1:
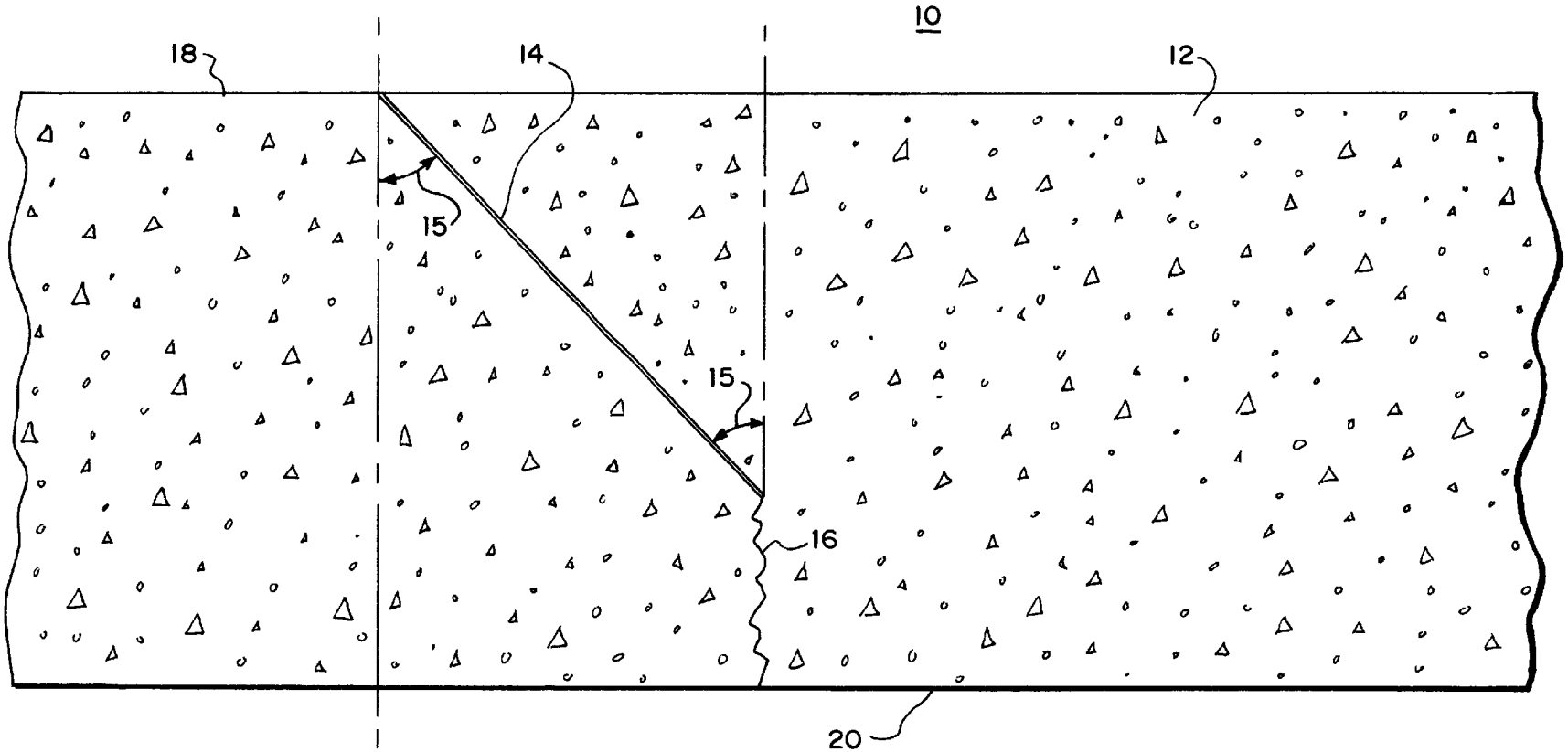
FIG. 1 is a fragmentary sectional schematic view of a portion of a concrete roadway in accordance with an embodiment of the invention.

In FIG. 1, there is shown a fragmentary sectional view of a concrete highway pavement 10 having a concrete slab 12 with an angular cut 14 from the surface 18 of the concrete slab 12 to a point at which it meets with a vertical cracked section 16 that extends to the bottom 20 of the concrete slab 12. The angular cut 14 and vertical cracked section 16 form a joint in the concrete pavement 10 extending across the width of the concrete pavement 10 as better shown in FIG. 2. While in the embodiment 10 of FIG. 1, the angular cut 14 extends to a point near the center of the section of the concrete slab 12, it may extend anywhere from a third of the depth of the concrete slab 12 to the bottom 20 of the concrete slab 12 at an angle 15. Wherever in that region it terminates, the concrete slab 12 cracks to form a joint extending from top to bottom and side to side under normal conditions. The concrete slab 12 may be of any conventional depth and is not part of the invention. The depth is determined by the design of the road. Similarly, it can be of any width, being intended to be used for a roadway or the like.

The angular cut 14 may be made by a concrete saw of the type now conventionally used to make vertical cuts. However, the saw blade must be positioned at an angle to the roadway rather than being vertical. In one embodiment, an otherwise conventional concrete saw for forming joints is modified so that the saw blade is at an angle to the roadway, in another embodiment, the vehicle to which the saw blade is mounted is positioned on a ramp that rests on the road surface 18 transverse to the longitudinal axis of the roadway. The ramp extends at least partway across the roadway and is shaped to cause the concrete saw to be at an angle so the saw blade cuts at an angle. With this arrangement, the saw blade that is mounted vertically while the concrete saw is on a horizontal surface is actually at an angle to the roadway. The angular cut 14 starts at the surface 18 of the concrete slab 12 and extends to the right in the direction the traffic is moving at an angle 15 to the vertical of between 5 and 45 degrees so that a vehicle moving in the normal direction of traffic has its wheels first contact the surface 18 where the angular cut 14 starts, causing this slab to move upwardly as shown by experience and then roll over the section in the direction the angular cut 14 extends toward the right as shown in FIG. 1 causing this slab to move down. This motion causes pressure at the angled joint, resulting in sliding and longitudinal motion of the slabs and pressing adjacent slabs of concrete together. As the angular cut 14 extends rightwardly in the direction of traffic, it also extends downwardly so as to make an angle 15 with the vertical, which angle 15 is in the range of between 5 and 45 degrees. The particular angle 15 at which the angular cut 14 extends, is determined by road conditions and the nature of the concrete itself.

Figure 2:
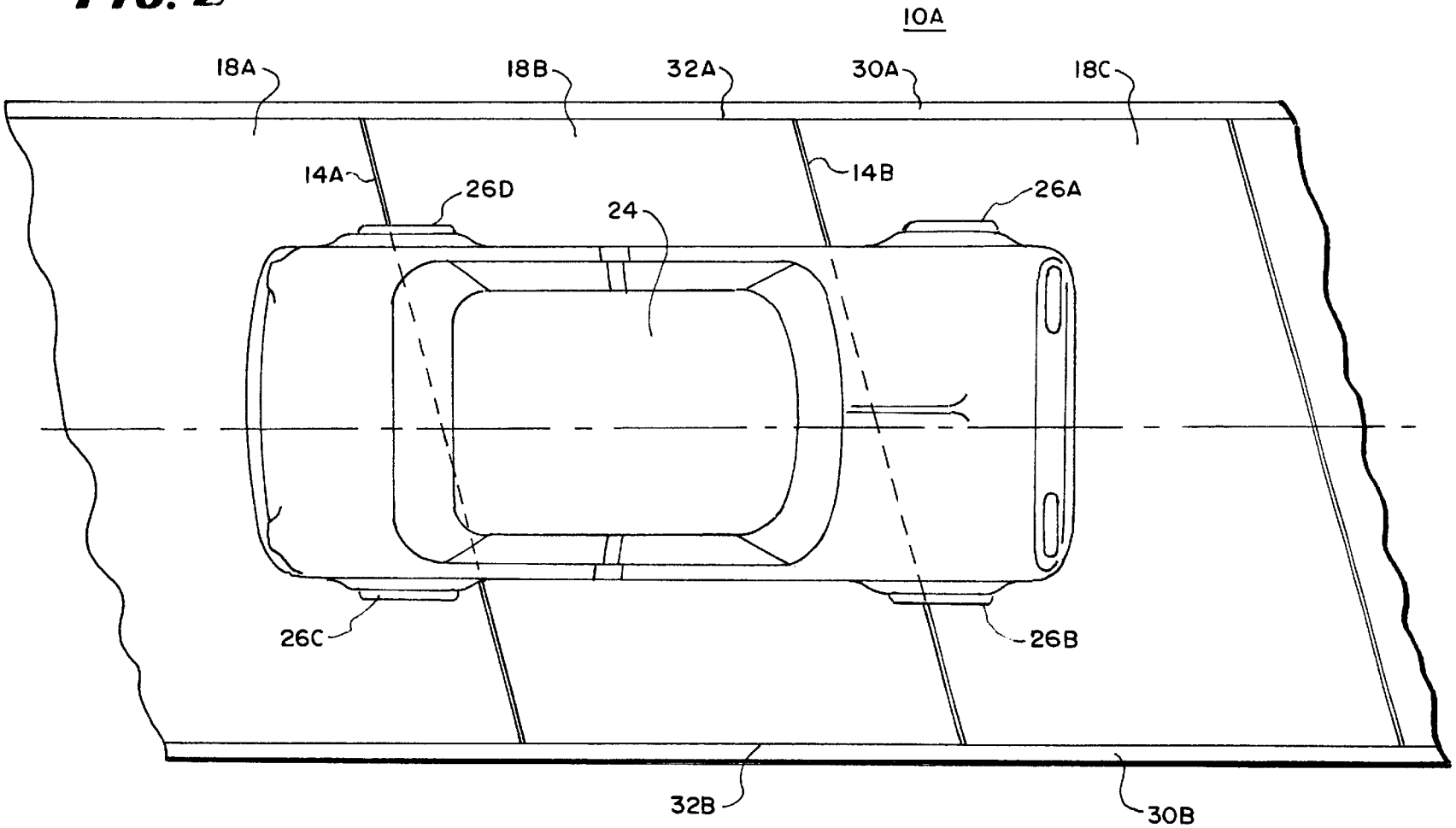
FIG. 2 is a schematic plan view of an embodiment of a one-way roadway showing the cuts from the surface downwardly and at an angle from one side of the one-way roadway to the other side of the one-way roadway with a vehicle shown for illustration.

In FIG. 2 there is shown a fragmentary plan view of a section of the pavement 10A having a plurality of angular cuts 14A and 14B similar to the angular cut 14 in FIG. 1 forming joints between a first, second, and third concrete slab having first, second and third surfaces 18A, 18B and 18C for illustration. A vehicle 24 is shown supported by its wheels 26A–26D on the pavement surfaces 18A, 18B and 18C. The joints comprising the angular cuts 14A and 14B extend from one edge of the pavement 32A to the other edge 32B between the curbs 30A and 30B and extend downwardly and in the direction of traffic across the pavement. They extend at an angle to the edges 32A and 32B of the pavement so that vehicles such as the vehicle 24 moving in a direction along the pavement 10A has a wheel such as 26A on the left side of the moving vehicle 24 first contacts the joint between a first surface 18B and second surface 18C and begins rolling over the second surface 18C that overlies the first surface 18B to the right of the joint as shown in FIGS. 1 and 2. Next, the right wheel such as 26B contacts the joint between the first surface 18B and second surface 18C and rolls over the second surface 18C. Similarly, because the joints are at an angle to the longitudinal axis of the roadway, the other wheels 26C and 26D successively contact the joint so that one wheel at a time contacts the joint.

While the joints that are at an angle from side to side of the roadway are desirable in concrete roadway pavement 10A, it is not an essential portion of the invention for the cuts to be at an angle but it is an improvement intended to reduce the impact of a vehicle 24 by more gradually applying weight. With this arrangement, the pavement 10A is cut into concrete slabs 12 from surface 18 to bottom 20 such as shown in FIG. 1 so that as vehicles 24 move across each of the respective concrete slabs 12 motion between the concrete slabs 12 is reduced by the weight of the vehicle and surface 18 of the concrete slab 12 pressing the adjoining concrete slabs 12 together at the angular cut 14, maintaining contact between the concrete slabs, and thus reducing cracks in the concrete caused by the uncontrolled motion of one concrete slab 12 moving with respect to and against another.

Figure 3:
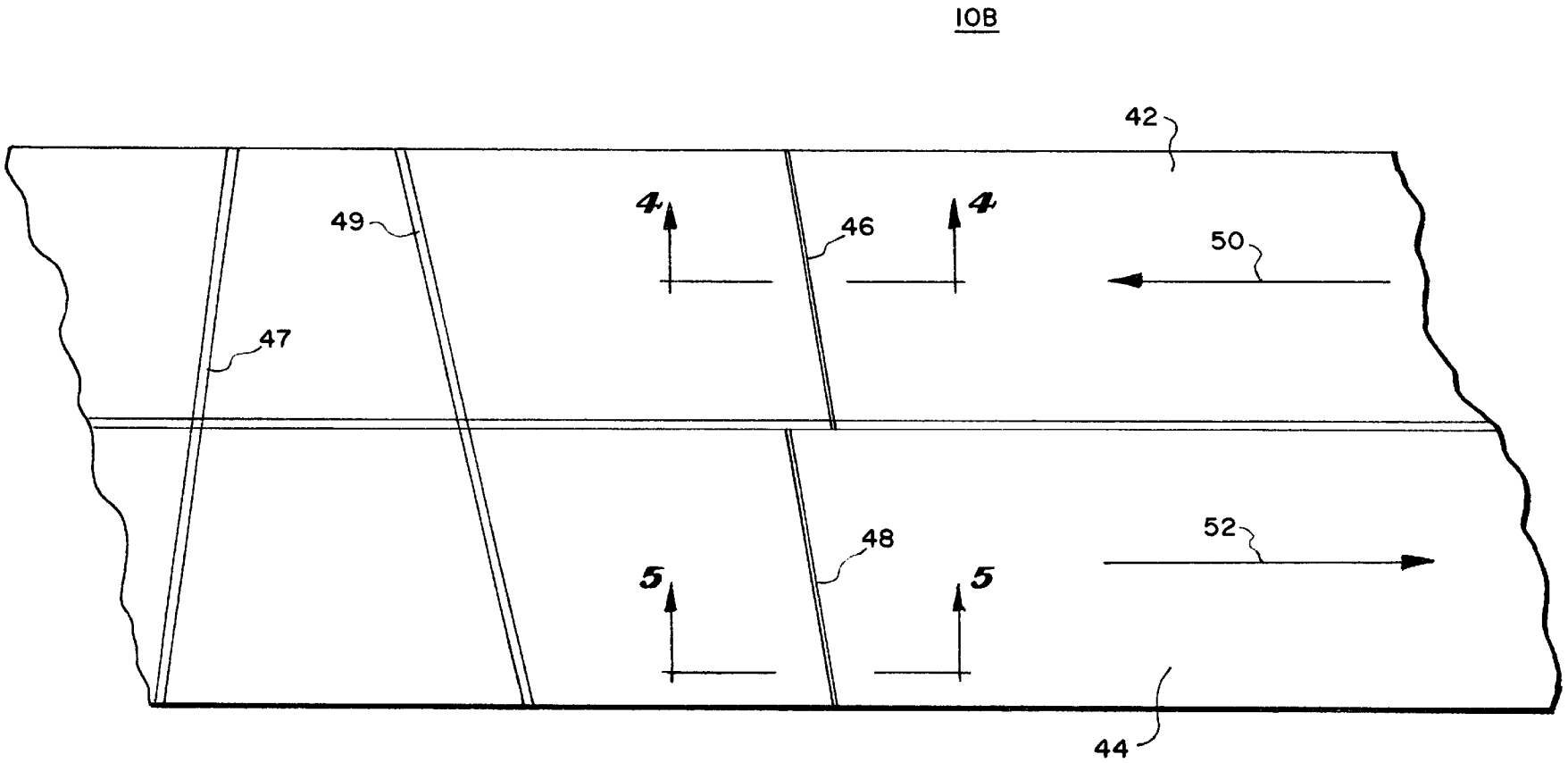
FIG. 3 is a plan view of an embodiment of a two-way roadway showing the cuts from the surface to the bottom and from one side to the other of each of the lanes.

FIGS. 1 and 2 show a section of roadway that is adapted for one-way travel. In FIG. 3, there is shown a plan view of a two-way, two-lane roadway with a typical joint across each of the two lanes. As shown in this view, it is preferred, but not necessary, for the joints to be slightly offset from one another. As shown in FIG. 3, the section of roadway 10B has a joint at 46 on the lane 42 over which the traffic moves in the direction of the arrow 50 and a joint at 48 in the opposite lane 44 over which the traffic moves in the direction of the arrow 52 opposite to the direction shown in the arrow 50. In the lane 42 moving in the normal direction of traffic has its wheels first contact the surface 18 where the angular cut 14 starts, causing this slab to move upwardly as shown by experience and then roll over the section in the direction the angular cut 14 extends toward the right as shown in FIG. 1 causing this slab to move down. This motion causes pressure at the angled joint, resulting in sliding and longitudinal motion of the slabs and pressing adjacent slabs of concrete together. As the angular cut 14 extends rightwardly in the direction of traffic, it also extends downwardly so as to make an angle 15 with the vertical, which angle 15 is in the range of between 5 and 45 degrees. The particular angle 15 at which the angular cut 14 extends, is determined by road conditions and the nature of the concrete itself.

In FIG. 2 there is shown a fragmentary plan view of a section of the pavement 10A having a plurality of angular cuts 14A and 14B similar to the angular cut 14 in FIG. 1 forming joints between a first, second, and third concrete slab having first, second and third surfaces 18A, 18B and 18C for illustration. A vehicle 24 is shown supported by its wheels 26A–26D on the pavement surfaces 18A, 18B and 18C. The joints comprising the angular cuts 14A and 14B extend from one edge of the pavement 32A to the other edge 32B between the curbs 30A and 30B and extend downwardly and in the direction of traffic across the pavement. They extend at an angle to the edges 32A and 32B of the pavement so that vehicles such as the vehicle 24 moving in a direction along the pavement 10A has a wheel such as 26A on the left side of the moving vehicle 24 first contacts the joint between a first surface 18B and second surface 18C and begins rolling over the second surface 18C that overlies the first surface 18B to the right of the joint as shown in FIGS. 1 and 2. Next, the right wheel such as 26B contacts the joint between the first surface 18B and second surface 18C and rolls over the second surface 18C. Similarly, because the joints are at an angle to the longitudinal axis of the roadway, the other wheels 26C and 26D successively contact the joint so that one wheel at a time contacts the joint.

While the joints that are at an angle from side to side of the roadway are desirable in concrete roadway pavement 10A, it is not an essential portion of the invention for the cuts to be at an angle but it is an improvement intended to reduce the impact of a vehicle 24 by more gradually applying weight. With this arrangement, the pavement 10A is cut into concrete slabs 12 from surface 18 to bottom 20 such as shown in FIG. 1 so that as vehicles 24 move across each of the respective concrete slabs 12, motion between the concrete slabs 12 is reduced by the weight of the vehicle and surface 18 of the concrete slab 12 pressing the adjoining concrete slabs 12 together at the angular cut 14, maintaining contact between the concrete slabs, and thus reducing cracks in the concrete caused by the uncontrolled motion of one concrete slab 12 moving with respect to and against another.

FIGS. 1 and 2 show a section of roadway that is adapted for one-way travel. In FIG. 3, there is shown a plan view of a two-way, two-lane roadway with a typical joint across each of the two lanes. As shown in this view, it is preferred, but not necessary, for the joints to be slightly offset from one another. As shown in FIG. 3, the section of roadway 10B has a joint at 46 on the lane 42 over which the traffic moves in the direction of the arrow 50 and a joint at 48 in the opposite lane 44 over which the traffic moves in the direction of the arrow 52 opposite to the direction shown in the arrow 50. In the lane 42 the joint 46 is at an angle as described in connection with FIG. 2 and the opposite lane 44 is also at an angle with the joints being offset and the angles being in the same direction which would be the opposite direction with respect to each other as far as the direction of traffic is concerned. It does not matter according to the principle of applying the weight gradually which edge of the lane has the start of the angled joint closest to the traffic just so the pressure is applied gradually one wheel at a time. Moreover, it is possible but not entirely desirable to change angles at alternate joints, such as at 47 and 49, and thus create some lateral movement. While the arrangement may not be as effective, it is easier to accomplish since the vehicles do not need to be turned around at the dividing line between the lanes bearing traffic in the opposite direction.

Figure 4:
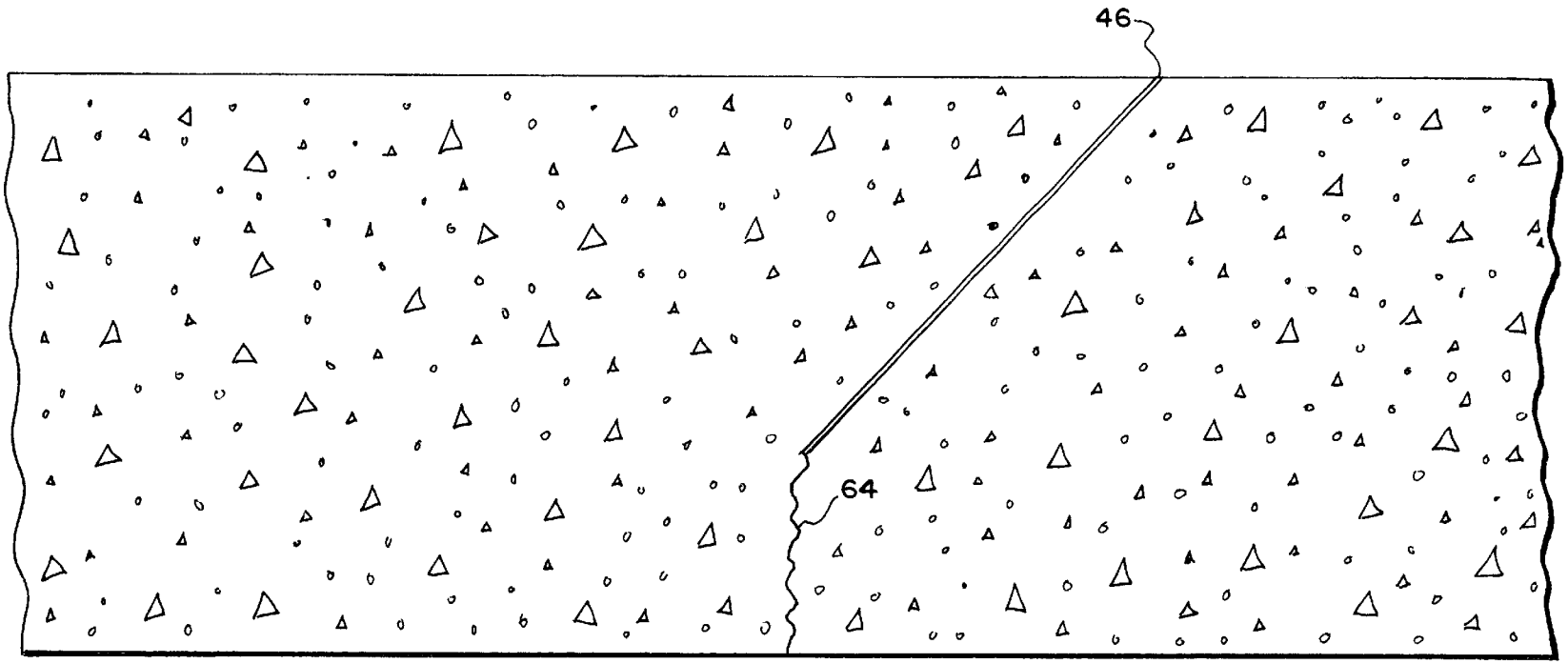
FIG. 4 is a sectional view taken through lines 4—4 of the embodiment of FIG. 3 showing a section of one half of a two-way roadway.
Figure 5:
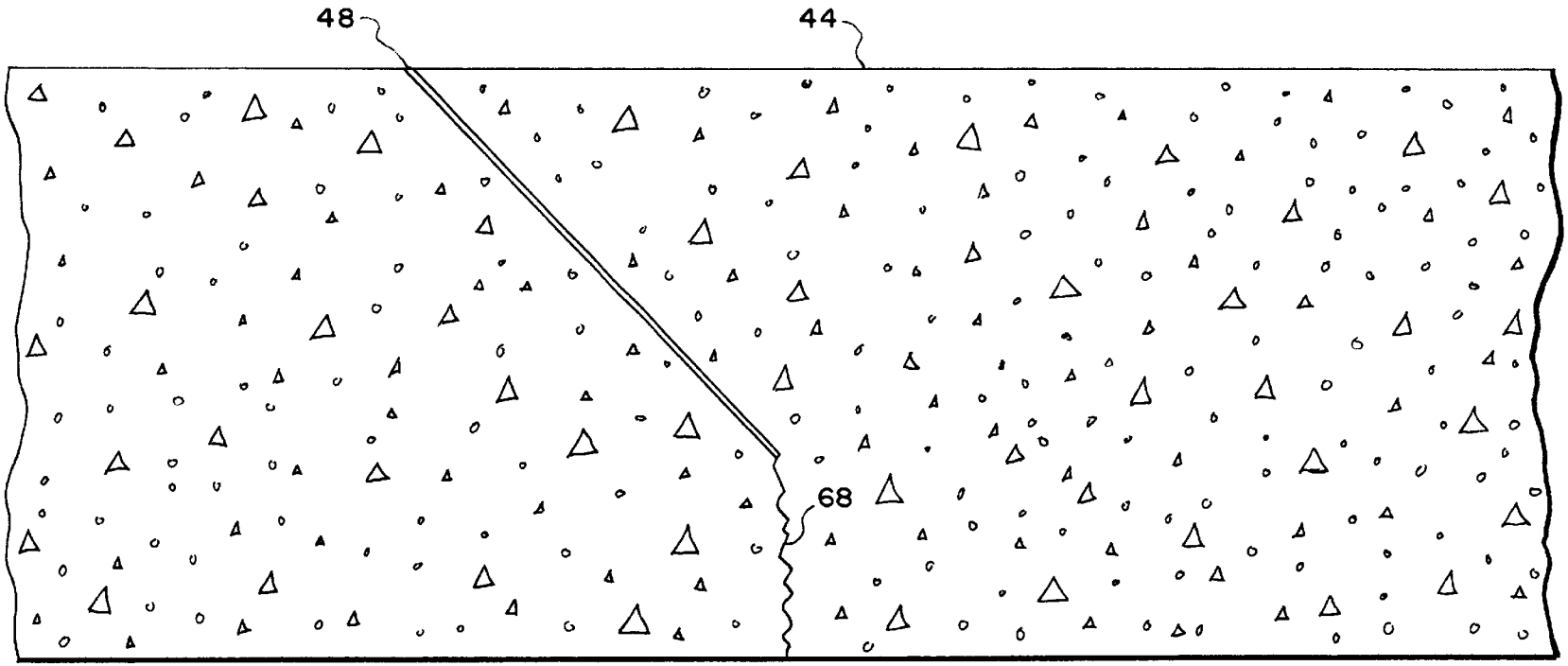
FIG. 5 is a sectional view of FIG. 3 taken through sections 5—5 showing a section of a roadway in the opposite direction from FIG. 4.
Figure 6:
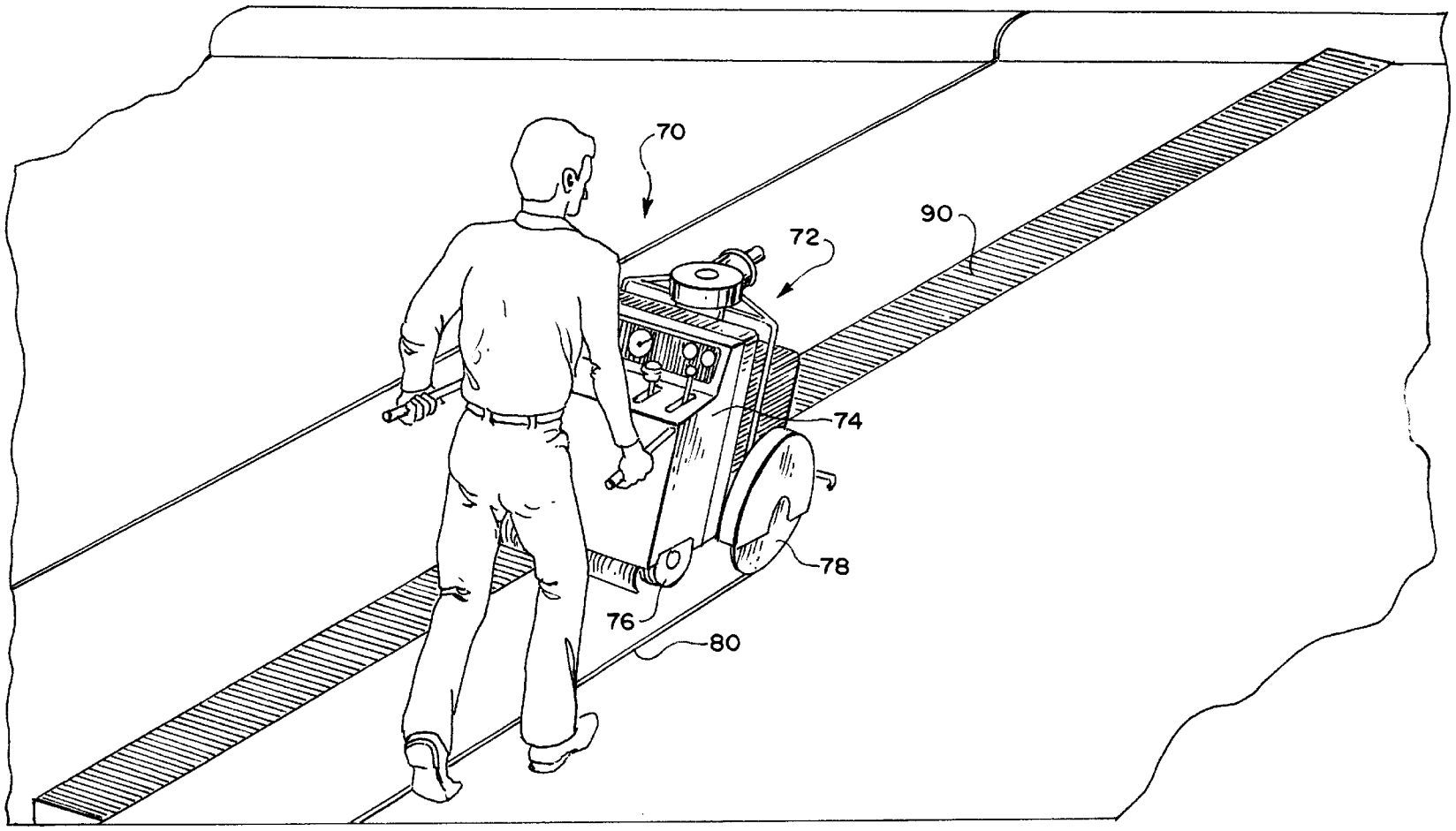
FIGS. 6 and 7 are perspective views from different angles of a concrete saw cutting pavement in accordance with a first embodiment of the invention.
Figure 7:
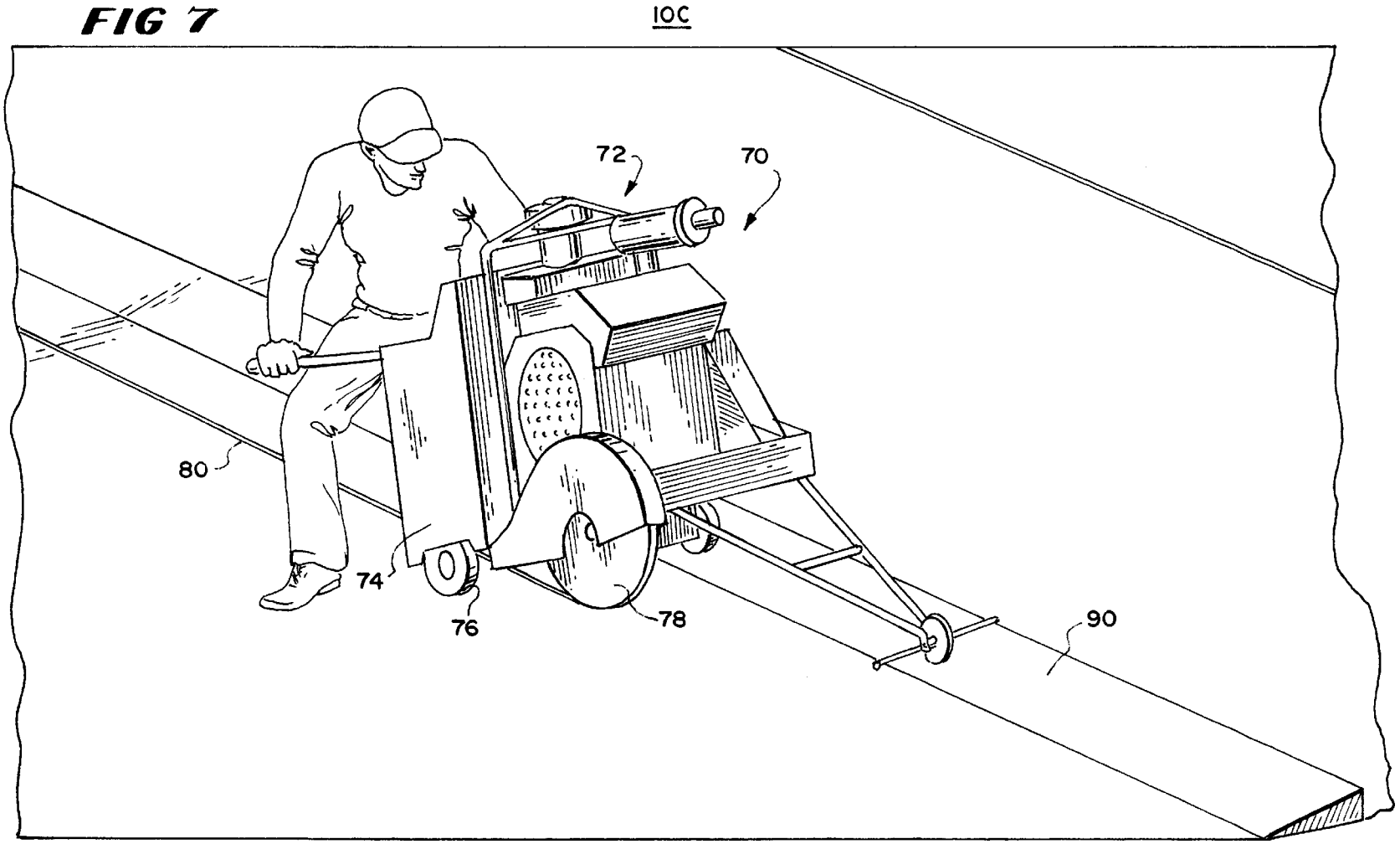

In FIG. 4 there is shown a sectional view taken along the section lines 4—4 in FIG. 3 showing the angular cut 62 at the joint 46 which is contacted by the wheels 26A–26D of a moving vehicle 24 at the surface 18 first and proceeding along as it presses against the concrete to the vertical cracked section 64. Similarly, in FIG. 5 there is shown a sectional view in the direction of the section lines 5—5 in FIG. 3 showing the angular cut 66 at the joint 48 slanting downwardly from the opposite direction so as to contact the weight of the vehicle 24 again in its normal direction near the surface 18 first and press the concrete downwardly to the vertical cracked section 68. In each of these cases the cuts are at an angle in the direction of traffic flow so as to be in the opposite direction from the adjoining side of the road. In FIGS. 6 and 7, there are shown perspective views from two different angles of a concrete saw system 70 having a concrete saw 72 and a ramp 90. The concrete saw 72 may be any suitable commercial unit on the market such as the Target Pro 65 II concrete saw manufactured and sold by Diamant Boart Inc. 4320 Clary Boulevard, Kansas City, Mo. 64130. This type of concrete saw 72 has a rotary saw blade 78, a body 74 which includes a saw motor and transmission and a roller and or wheels 76. The rotary saw blade 78 extends in a vertical plane aligned with the direction of motion of the vehicle 24 positioned to cut a pavement section 10C to form a joint 80. As shown in this view, one side of the roller or wheels 76 is on the ramp 90 and the other side of the roller or wheels 76 of the concrete saw 72 are on the pavement so as to tilt the rotary saw blade 78 at an angle to the pavement. In this embodiment, a conventional joint concrete cutting saw 72 may be used a ramp 90 placed at the appropriate location for a cut so that the vehicle 24 may move up the ramp 90 and position the rotary saw blade 78 at an angle to make an angular cut 14 which angle is the appropriate angle. The angle is normally selected to be an angle of between 5 degrees and 45 degrees from the vertical. The rotary saw blade 78 must be sufficiently long so that it may be moved downwardly as it rotates in a conventional manner to make the desirable depth of angular cut 14 and then retracted.

Figure 8:
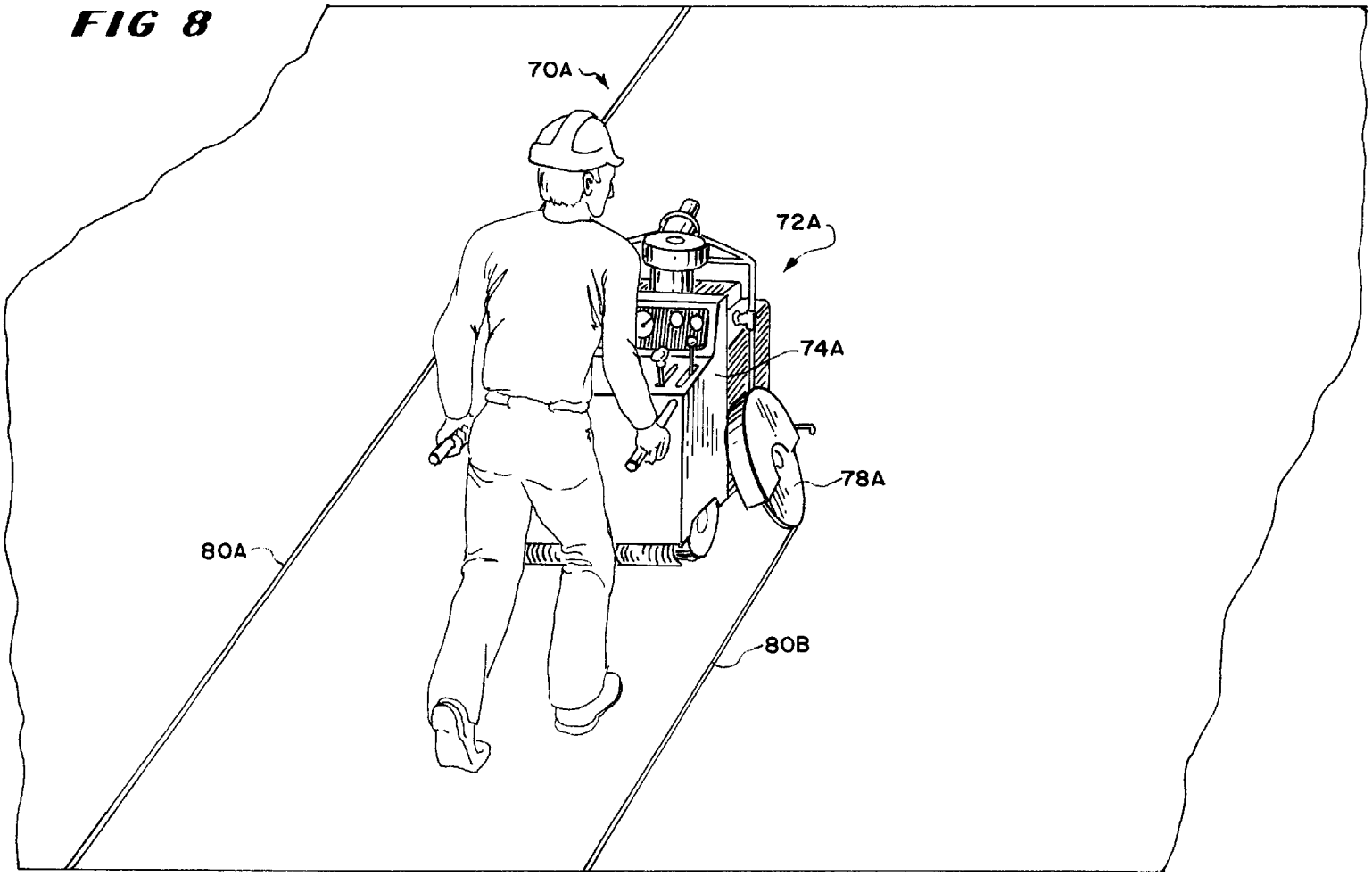
FIGS. 8 and 9 are perspective views of a concrete saw for cutting the roadway in accordance with a second embodiment of the invention.
Figure 9:
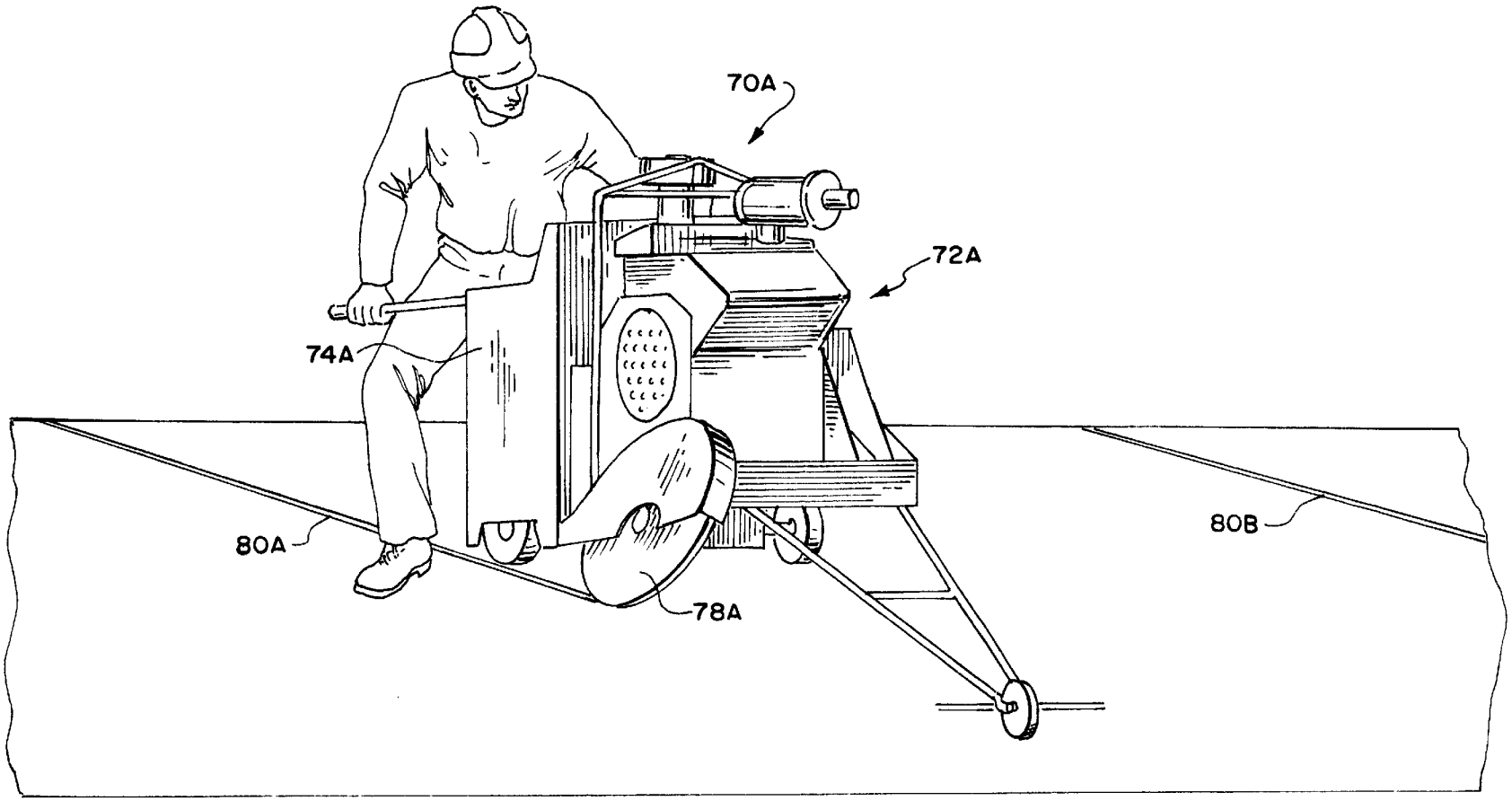

In FIGS. 8 and 9, there are shown two perspective views from different angles of another embodiment 70A of the invention having a concrete saw 72A. In the concrete saw 72A unlike the concrete saw 72 shown in FIGS. 6 and 7, a rotary saw blade 78A is mounted at a vertical angle to the body 74A so that, with its wheels 76 positioned on a horizontal surface, the rotary saw blade 78A may be moved at an angle downwardly to make an angled cut in the concrete pavement 10 to form joints 80A and 80B. There are many ways of mounting the rotary saw blade 78A so that it can rotate and move at the angle and only one of these is shown and described in this application. However, any apparatus will serve that function since the exact method of mounting is not a part of the invention itself and any suitable, workable method is an equivalent.

Figure 10:
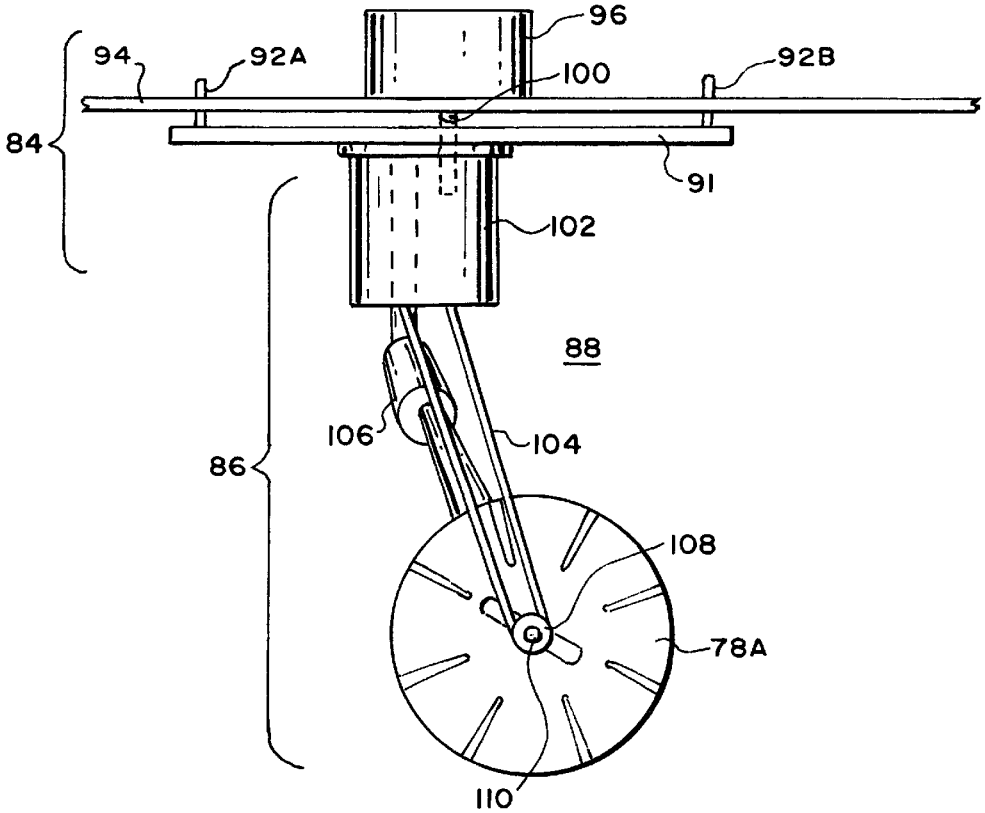
FIGS. 10 and 11 are perspective views of a portion of a concrete saw in accordance with the invention.
Figure 11:
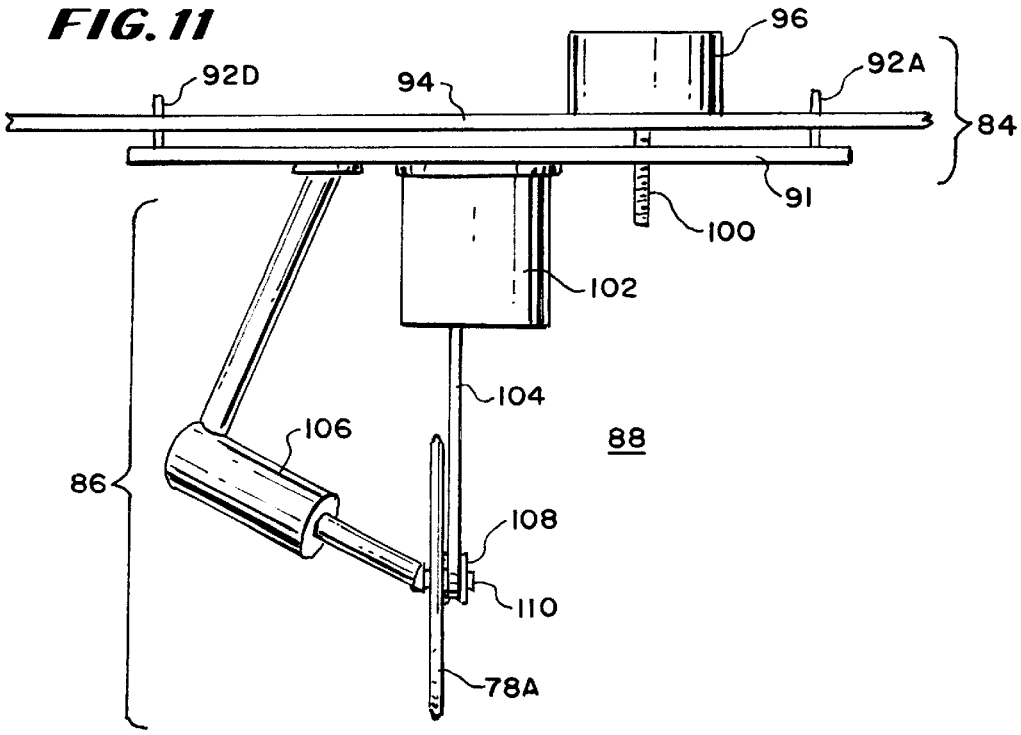

In FIGS. 10 and 11, there are shown two fragmentary perspective views from two different angles of a mounting mechanism 88 for mounting the rotary saw blade 78A at a selected angle to a roadway and to move it upwardly and downwardly while the rotary saw blade 78A is rotating at least as it moves downwardly into the pavement 10. For this purpose, the mounting mechanism 88 includes a vertical adjusting mounting system 84 and an angular positioning system 86.

The vertical adjusting mounting system 84 includes a vertical adjustable mounting plate 91, four sliding alignment shafts 92A–92D (92A and 92B being shown in FIG. 10 and 92A and 92D being shown in FIG. 11), a vertical drive motor 96 and a vertical drive screw 100. The vertical drive motor 96 is mounted on top of a horizontal metal plate 94 of the concrete saw 72 to rotate the vertical drive screw 100 that passes through the horizontal metal plate 94 and threadably engage the vertical adjustable mounting plate 91 so that rotation of the vertical drive motor 96 turns the vertical drive screw 100 within a threaded opening in the vertical adjustable mounting plate 91 to raise or lower the vertical adjustable mounting plate 91. The sliding alignment shafts 92A–92D aid in holding the vertical adjustable mounting plate 91 horizontal. The angular positioning system 86 is mounted to the plate 91 and positions the rotary saw blade 78A and its vertical drive motor 96. With this arrangement, the rotary saw blade 78A can be lowered as it cuts the concrete and raised when desired.

To angularly position the rotary saw blade 78A, the angular positioning system 86 includes a rotary saw drive motor 102 mounted to the vertical adjustable mounting plate 91, a drive belt 104 and a hydraulic piston 106. The hydraulic piston 106 is mounted fixedly at one end to the vertical adjustable mounting plate 91 to move vertically with it and at the other end to the rotary saw blade 78A to firmly position the rotary saw blade 78A at a selected angle and hold it in position with respect to the vertical adjustable mounting plate 91 and thus position the angle of the rotary saw blade 78A as the vertical adjustable mounting plate 91 moves. With this arrangement, the rotary saw blade 78A can be rotated by the electric, rotary saw drive motor 102 through the drive belt 104 while held at a suitable angle between 5 degrees and 45 degrees from the vertical adjustable mounting plate 91 as the vertical adjustable mounting plate 91 moves the entire assembly downwardly to cut the concrete. At a vertical angle, it may be used as shown in the embodiment 70 of FIG. 6 and at an angle of between 5 degrees and 45 degrees it may be used as shown in the embodiment of FIG. 7.

To rotate the rotary saw blade 78A, a rotary saw drive motor 102 is mounted to the vertical adjustable mounting plate 91 and drives a drive belt 104 which engages a sprocket 108 that rotates the rotary saw blade 78A about its bearings 110. With this arrangement, the hydraulic piston 106 is positioned and is mounted in position so that the concrete saw 72 may move along the angular cut (14 in FIG. 1) to move deeper and deeper at the angle controlled by the hydraulic piston 106 and at a depth controlled by the vertical adjustable mounting plate 91. The hydraulic piston 106 and the rotary saw drive motor 102 are firmly mounted to the vertical adjustable mounting plate 91 so they all move together at the angle set by the position of the hydraulic piston 106 and at a depth set by the vertical adjustable mounting plate 91. The vertical drive motor 96 moves the rotary saw blade 78A downwardly and upwardly with the vertical adjustable mounting plate 91. Of course, the wheel need not be rotated as it moves upwardly.

Although the control mechanisms for actuating the rotary saw drive motor 102, the hydraulic piston 106 and the like are not shown, they are conventional and are the conventional mechanisms used to operate pistons and drive means. While a specific embodiment of piston and drive motor have been shown, of course there are many variations. Instead of a hydraulic piston for example, a ball screw may be used or any other type of actuator or lever means or the like adapted to move the rotating blade in another direction. Similarly, the rotary saw blade 78A may be driven by many other mechanisms or by electrical motors that are mounted directly on the bearings instead of being mounted by a drive belt or mounted by any other means all of which are easily determined by an appropriate engineer.

As can be understood from the detailed description above, the concrete saw of this invention has several advantages, such as it can be easily adjusted at an angle so as to not require a ramp for a conventional saw blade to cut an angular cut into the roadway. The technique for making joints in the concrete road has the advantage of not requiring steel reinforcing rods to prevent excessive rubbing of the two sides of the joint together with its accompanying cracking. This saves a substantial amount of money because of the multiple joints that are needed along the road.

Although a preferred embodiment of the invention has been described with some particularity, many modifications and variations of the invention are possible in light of the above teachings. Therefore, it is to be understood that, within the scope of the appended claims, the invention may be practiced other than as specifically described in the preferred embodiment.

What is claimed is:

1. A method of making a concrete roadway comprising the steps of:

pouring a continuous section of concrete having a length, a depth and a width;

cutting the continuous section of concrete from a top surface of the continuous section of concrete between a first part of the continuous section of concrete and a second part of the continuous section of concrete downwardly in a direction from the second part of the continuous section of concrete toward the first part of the continuous section of concrete at an angle of between 5 degrees and 45 degrees from the vertical to form an angled cut between a wedged shaped end of the first part of the continuous section of concrete and a wedged shaped end of the second part of the continuous section of concrete, whereby the wedged shaped end of the first part of the continuous section of concrete overlies the wedged-shaped end of the second part of the continuous section of concrete wherein the wedged shaped end of the first part of the continuous section of concrete and the wedged shaped end of the second part of the continuous section of concrete can be pressed together by a vehicle to reduce movement of the first part of the continuous section of concrete with respect to the second part of the continuous section of concrete on either side of a joint formed by the angled cut;

said step of cutting the continuous section of concrete comprising the step of cutting the continuous section at an angle to the length of the continuous section.

2. A method in accordance with claim 1 in which the step of cutting the continuous section of concrete from a top surface of the continuous section of concrete between a first part of the continuous section of concrete and a second part of the continuous section of concrete downwardly in a direction from the second part of the continuous section of concrete toward the first part of the continuous section of concrete surface comprises the step of cutting downwardly and in the direction of traffic flow, whereby vehicles will press the wedged shaped end of the first part of the continuous section of concrete downwardly against the wedged shaped end of the second part of the continuous section of concrete and will press the wedged shaped end of the second part of the continuous section of concrete upwardly against the wedged shaped end of the first part of the continuous section of concrete.

3. A method in accordance with claim 1 in which the cut is in a direction downwardly of between one third of the total depth to the total depth.

4. A method in accordance with claim 1 in which the continuous section of concrete roadway is formed of concrete having an additive.

5. A method in accordance with claim 1 in which a rotary saw blade is used to cut the continuous section of concrete, the rotary saw blade being mounted at an angle to the concrete roadway.

6. A method in accordance with claim 5 in which the rotary saw blade is mounted to a vehicle and the vehicle is positioned so that the rotary saw blade is at an angle to the roadway.

7. A method in accordance with claim 6 in which the vehicle includes a first apparatus for rotating the rotary saw blade; a second apparatus for positioning the blade at a selected angle with respect to the roadway of between 5 degrees and 45 degrees and a means for moving the saw blade into the concrete roadway to cut the concrete roadway.

* * * * *